US005138774A

United States Patent [19]

Sarkozi

[11] Patent Number: 5,138,774

[45] Date of Patent: Aug. 18, 1992

[54] INSOLE WITH REMOVABLE, HEIGHT-ADJUSTABLE STACKABLE SUPPORT PADS

[76] Inventor: Jeff Sarkozi, 1117 N. Avila Pl., Orange, Calif. 92669

[21] Appl. No.: 699,979

[22] Filed: May 13, 1991

Related U.S. Application Data

[63] Continuation-in-part of Ser. No. 541,386, Jun. 4, 1990, abandoned.

[51] Int. Cl.[5] ..... A61F 5/14

[52] U.S. Cl. ..... 36/164; 36/160; 36/159

[58] Field of Search ..... 128/596, 601, 606, 605, 128/622, 621, 595

[56] References Cited

U.S. PATENT DOCUMENTS

| | | | |
|---|---|---|---|
| 988,942 | 4/1911 | Krech et al. | 128/622 |
| 1,272,994 | 7/1918 | Phelps | 128/605 |
| 1,423,456 | 7/1922 | Roth | 128/596 |
| 1,690,964 | 11/1928 | Balaskas | 128/605 |
| 2,123,176 | 7/1938 | Block | 128/605 |
| 2,220,439 | 11/1940 | Block | 128/596 |
| 2,487,691 | 11/1949 | Boos | 128/606 |
| 3,143,812 | 8/1964 | Bittner | 128/596 |
| 4,642,912 | 2/1987 | Wildman et al. | 128/595 |

FOREIGN PATENT DOCUMENTS

| | | | |
|---|---|---|---|
| 0193462 | 1/1938 | Austria | 128/606 |

*Primary Examiner*—Richard J. Apley
*Assistant Examiner*—Lynne Reichard
*Attorney, Agent, or Firm*—Willie Krawitz

[57] ABSTRACT

A deformable, elastic insole liner is provided with height adjustment pads for shoes to independently support the heel area, the longitudinal arch area, and the metatarsal arch area. Each pad comprises a base pad and a plurality of thin stacking pads which completely overlay the base pad and any stacking pads, and are self stabilized thereby. The stacking pads may be removably stacked onto each base pad, without requiring a fixed means of attachment to each other, in order to achieve the proper height adjustment for an individual user. This enables an individual shoe to be separately height adjusted for any combination of heel, longitudinal arch and metatarsal areas. In addition, after an initial adjustment, a particular support can be further height adjusted after a period of time, as necessary. This enables the user to adjust a shoe to treat the initial support problem, and subsequently to readjust the support for ongoing changes in the arches and heel areas.

18 Claims, 1 Drawing Sheet

INSOLE WITH REMOVABLE, HEIGHT-ADJUSTABLE STACKABLE SUPPORT PADS

This application is a continuation-in-part of U.S. Pat. application Ser. No. 07/541,386 filed Jun. 4, 1990, now abandoned.

BACKGROUND OF THE INVENTION

This invention relates to an insole support with arch and heel pads for shoes which provide for a variable height by the user in the separate areas of the heel, the longitudinal arch and, the metatarsal arch areas of the foot. The arch and heel supports of this invention comprise support bases in the heel, longitudinal and metatarsal areas onto s which are placed thin, removable pads which function to produce a variable height support for the user.

Typical publications in this area are U.S. Pat. Nos. 988,942; 1,078,708; 1,272,994; 1,880,654; 2,487,691; 2,545,910; 2,790,975; 4,517,981; 4,520,581; and, 4,642,912; German patents 461,385 (1928); and, 475,304 (1928); and, Austrian Patent 147,022 (1936).

The problem in some instances of the prior art is that the height supports are sewed or laminated together, or are otherwise non-adjustable, and this type of shoe is exemplified in U.S. Pat. Nos. 988,942; 1,078,708; 2,545,910; and, German Patent 475,304.

In other cases, for example in U.S. Pat. No. 1,272,994, the materials of construction are not elastically deformable, and therefore the spaces for support elements cannot envelope and laterally support these elements therein, and hence the support elements will have the tendency to become displaced within the support space or fall out.

In still other cases, for example in U.S. Pat. No. 1,272,994, elastic insole layers are provided, between which are defined a plurality of spaces which require the installation of a separate pocket to receive a singular support pad. However, there is no provision for a plurality of adjustable support pads.

Other types of shoes only provide a height support element which extends along the entire length or major portion of the shoe length, and hence does not enable the wearer to individually adjust the height support at the heel area, longitudinal arch area, and the metatarsal area. U.S. Pat. Nos. 4,517,981; 4,642,912; and, Austrian Patent 147,022 illustrate this type of height support element which extends along a portion of the shoe length.

Other types of arch supports are disclosed which employ replaceable filling layers, such as in German Patent 461,385. However, the arch support in the German patent is independent of the insole and uses an external locking flap to secure the layers. Preferably, a unitary, deformable, elastic insole liner should be provided into which removable height support pads could be adjustably placed, while still having individual supports for the three main areas of the foot itself.

Still other shoe support systems such as in U.S. Pat. No. 4,520,581 employ a preformed plastic insole designed to accommodate a particular user's foot. However, preformed plastic insoles are quite expensive, and if the user's foot alignment changes, then the preformed insole must be changed.

THE INVENTION

According to the invention, a height adjustment system for shoes is provided comprising a removable and deformable elastic lining element into which are inserted separate height adjustment pads, comprising a base pad and one or more added stacking pads. The base pads and added stacking pads do not require a fixed means of attachment to each other. The elastically deformable lining element secures the height adjustment pads and maintains them in an anatomically correct position. This arrangement will properly support the heel area, longitudinal arch area, and metatarsal area.

The elastic lining elements define intrinsically formed support spaces which envelope and provide a resistive force towards the pads, thereby preventing their lateral displacement within the spaces.

Each height adjustment pad comprises a base pad in the lining element, if needed, and a plurality of thin self stabilizing removable stacking pads which completely overlay the base pad may be added to produce additional height adjustment for the user. The base pad itself not only provides a height adjustment, but also mounts and stabilizes the positioning of the removable stacking pads. Depending on the user's requirements, support at the metatarsal arch, longitudinal arch and heel areas or combinations thereof can be provided for by insertion into the deformable lining element of the appropriate base pads and removable pads. This gives the user a wide flexibility in adjusting the insole of the shoe to the proper height, and on an individual basis, without requiring professional medical assistance, and without requiring the user to continually purchase a new insole device. Hence, if a particular pad arrangement results in inadequate or excessive support, either of which may produce discomfort, the problem can easily be treated by adding or removing one or more removable pads from a base pad.

The height adjustment system of this invention does not function by joining the removable pads together such as by sewing, laminating, etc., and does not employ a preformed plastic sole which is quite expensive to manufacture. Instead, the user can adjust the pads to accommodate for ongoing requirements caused by short and long term disabilities, or due to minor adjustment needs.

BRIEF DESCRIPTION OF THE DRAWINGS

FIGS. 5 (*a–d*) are plan, sectional side elevation, rear elevation and perspective views, respectively of the base pad for the heel in the lining element;

FIGS. 5 (*e* and *f*) are two alternative rear elevation view embodiments of the base heel pad in the lining element;

FIGS. 6 (*a* and *b*) are sectional side and rear elevation views showing stacked removable pads mounted on the base pad of FIGS. 5*b* and 5*e*, respectively;

FIGS. 7 (*a–e*) are plan, front, side, back and perspective views, respectively of the base pad for the metatarsal arch area in the lining element;

FIGS. 9. (*a–d*) are plan, side, front, and perspective views, respectively of the base pad for the longitudinal arch in the lining element;

DESCRIPTION OF THE PREFERRED EMBODIMENTS

Figures 1, 2, 3, 4, 5A, 5B, 5C, 5D, 5E, 5F, 6A, 6B, 7A, 7B, 7C, 7D, 7E, 8, 9A, 9B, 9C, 9D, 10, 11:
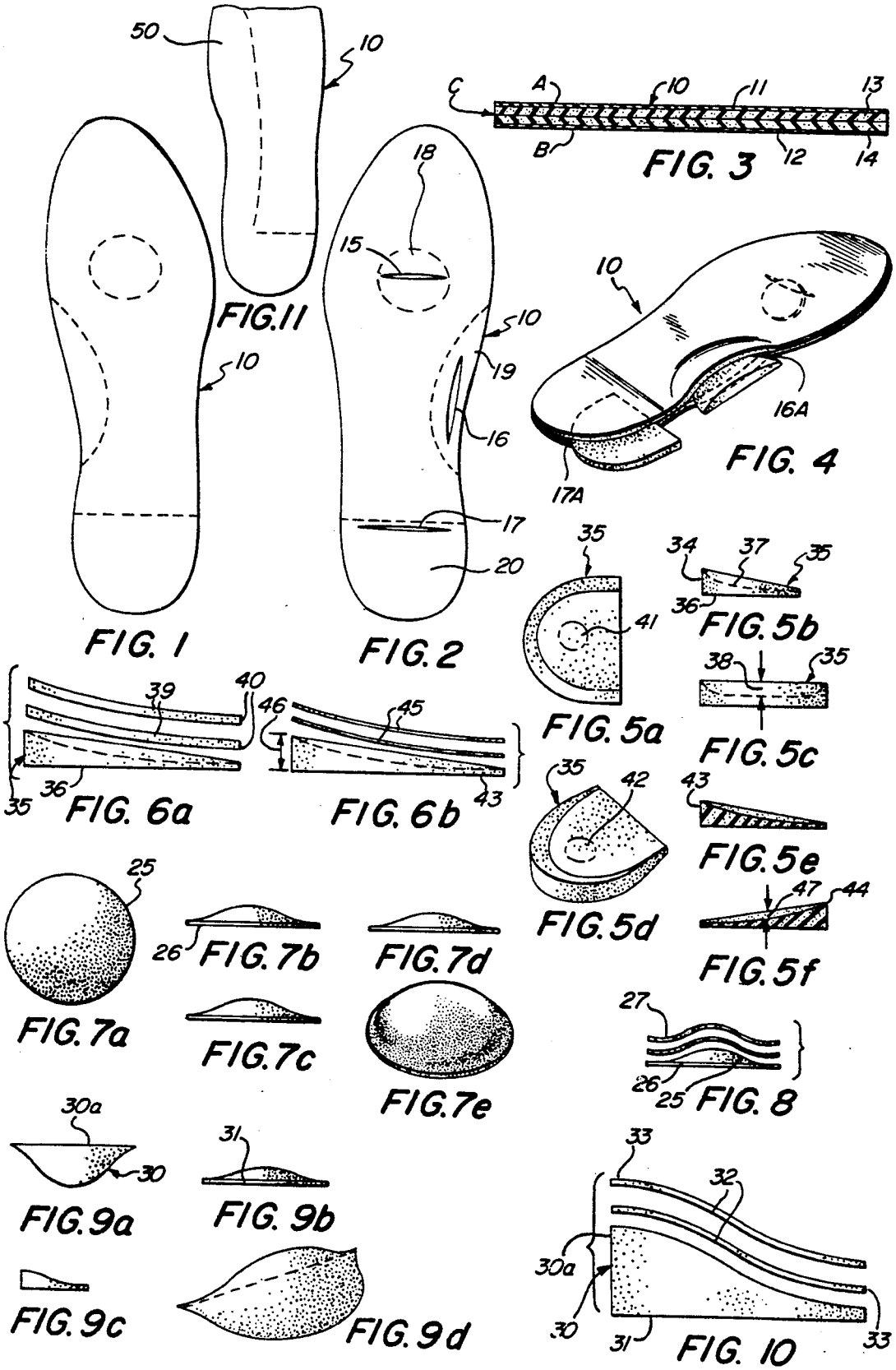
FIG. 1 is a plan view of a removable lining element showing the support locations for the three areas of the foot.
FIG. 2 is a bottom view of the removable lining element showing the support locations and openings for insertion and removal of the supports for the three areas of the foot.
FIG. 3 is a sectional side elevation view of the removable lining element.
FIG. 4 is a perspective view of the base pads inserted into the respective areas of the removable lining element.
FIG. 8 is a sectional side elevation view showing stacked removable pads mounted on the base pad of FIG. 7*c*.
FIG. 10 is a sectional side elevation view showing stacked removable pads mounted on the base pad of FIG. 9*c*.
FIG. 11 is a plan view of another embodiment of the removable lining element showing overlap of the support locations for the three areas of the foot.

The removable lining element 10 for the arch and heel supports of this invention is shown in FIGS. 1–4, and in FIG. 3, comprises a set A of two layer elements 11 and 13 bonded together, and a set B of two layer elements 12 and 14 also bonded together. When assembled, layers A and B are joined along an interface C. Layers 11 and 12 may be formed of fabric material such as polyesters, cotton, wool, nylon, acrylics, etc., and blends thereof. Layers 13 and 14 are preferably constructed of an elastic material such as foam, rubber, polyurethane, neoprene, latex, styrene-butadiene latex, polyethylene, polyolefin, pvc, and mixtures thereof, etc. The materials of layers 13 and 14 may be the same or of different compositions. Other elastic materials may include natural or artificial leather, cork, compressed natural or artificial fibers etc. Compressed natural or artificial fiber may consist of cotton, wool, nylon, polyesters, acrylics, and blends thereof, etc.

Preferably, each elastic layer 13 and 14 is about 1/64"–¼" thick. It is important that lining element 10 be made of elastic deformable material to enable insertion and retention of the base pads and stacked removable pads, and to maintain the stacked pads self stabilized and aligned.

The deformable elastic layers define and envelope the support spaces (infra) to provide a resistive force towards the pads, thereby preventing their lateral displacement within the support spaces. When formed into the unitary structure of lining element 10, the layers A and B are shaped to conform with typical shoe sizes.

Joining layers A and B to form the lining element 10, will bond the surfaces of layers 13 and 14 along interface C except in those areas where openings and cavities are required for insertion and retention of the base pads and stacked removable pads. When manufacturing lining element 10, a non adherent blank such as metal, teflon, silicone coated material, etc., may be placed between layers 13 and 14 in those specific areas where the openings and cavities are formed to prevent bonding of these specific areas. The joining operation may use adhesives, heat sealing, heat stitching, regular stitching, etc.

In place of layers A and B, the lining element 10 may be formed by utilizing at least two layer elements 13, 14 of the elastic material described supra. FIGS. 2, 3 and 4 show openings 15, 16, 17 formed through bottom layers 12 and 14; corresponding spaces or cavities 18, 19, 20 are intrinsically formed between layers 13 and 14, i.e., along interface C, to enable insertion of the base pads and stacked removable pads. The surface area of openings 15, 16, 17 are smaller than the surface area of the corresponding lining element layer exposed to the respective cavities 18, 19, 20. Since the openings are deformable and elastic, the base pads can be forced into and expand and fit into the cavities. This prevents the base and stacked pads from slipping out of the cavities following installation, to maintain the stacked pads aligned.

As shown in FIG. 2, the elastic opening 15 to the elastic metatarsal arch support space 18 through bottom layers 12 and 14 may be oval to circular in shape. Space 18 is oval, to semi-circular to circular in shape, has typical dimensions of about ½"–4" for the minor and about ½"–4" for the major axes of the oval space, and about ½"–4" for the circular space. Space 18 is located between the front end and s mid portion of lining element 10 and approximates the midline of the long dimension.

Elastic opening 16 to the elastic longitudinal arch support space 19 is a semi-circular to crescent-shaped slot, as shown, and space 19 which may have a semi-circular to crescent shape is about ½"–3" in width, and about 1"–6" in length. Opening 16 may be formed as a hole through the bottom layers 12 and 14 as illustrated in FIG. 2, or it may be formed as a slot 16A between layers 13 and 14 (i.e., along interface C), and about midway of the lining element 10, as shown in FIG. 4. Arch support space 19 is about mid length of lining element 10 and displaced to its edge.

The elastic opening 17 to elastic heel support space 20, as shown in FIG. 2, is an oval-shaped slot, and space 20 is approximately semi-circular in shape. Typically, space 20 extends across the entire width of the lining element 10, and is about 1"–6" long. The elastic opening 17 is shown formed as a hole through the bottom layers 12 and 14 in FIG. 2, but opening 17 may also be formed as a slot 17A between the layers 13 and 14 (i.e., along interface C) at the back portion of the lining element 10, as shown in FIG. 4.

The metatarsal base pad 25 shown in FIG. 7*a* is circularly shaped, but may vary from semi-circular to circular to oval to circular in shape and is about ½"–4" in length or width. As shown in FIGS. 7 (*b–e*), the upper surface of the base pad rises in a curvilinear manner from a thin edge to a height of about 1/64"–¾". The bottom 26 of the base pad is relatively flat. A plurality of thin, removable pads 27 are stacked so as to be self stabilized, and to completely overlay the base pad 25 and provide height adjustment for the wearer, without being attached to each other. The removable pads 27 are similarly shaped and contoured to fit over and be stabilized by the underlying base pad 25, and any added stacking pads. The removable pads provide a numerical increment in width and length of about 1/64"–½". The height or thickness midway of a removable pad is about 1/64"–½", and this height tapers to a thin edge. Removable pads 27 are the same or similar composition as base pad 25.

The longitudinal arch support base pad 30 shown in FIGS. 9 (*a–d*) is about ½"–3" wide, and about 1"–6" in length. The pad has a semi-circular to curvilinear shape and curves upwardly from a thin edge to an elevation of about 1/64"–¾". The bottom 31 of the pad is relatively flat and the free edge 30*a* follows the contour of lining element 10. A plurality of these thin, removable stacking pads 32 are shown in FIG. 10, and are similarly shaped and contoured to fit, overlay and be stabilized by the underlying base pad 30, and to be stabilized by any other underlying stacking pads, without requiring a fixed means of attachment to each other. The removable pads are slightly larger than the base pad and will add incrementally to the length and width of a previous pad to the extent of about 1/64"-½". The height or thickness about midway of a removable stacking pad 32 is about 1/64"-½", and this height tapers to a thin edge 33.

The heel base pad 35, shown in FIGS. 5 (*a-d*) is generally semi-circular or U-shaped, with a relatively flat bottom 36, and the upper surface is contoured to present a concave downward shape. The height at the back end 34 of the heel base pad can vary from about 1/64"-¾". A center drop distance 38 of about 1/64"-¾" is provided, as shown in FIG. 5*c*. The pad 35 defines a downward taper in height from back to front by about 1/64"-¾", and terminates in a low edge thickness, as shown in FIG. 5*b*. The heel base pad 35 is about 1"-6" in length, and is about 1"-6" in width, and the pad extends across the width of the lining element 10.

The type of heel base pad shown in FIGS. 5 (*a-d*) represent a relatively even, non-inclined support in the left or right direction across the width of the heel base pad. However, in other instances, the heel base pad may be inclined in either a right direction 43, or left direction 44, as shown in FIGS. 5*e* and 5*f*, respectively. These inclinations are designed to offset corresponding angular deformities when present in the user's heel area. Typically, the heel base pads of FIGS. 5*e* and 5*f* are generally semi-circular or U-shaped, with a relatively flat bottom, and the upper surface is contoured to present a concave downward shape.

The height at the back end 46 of heel base pad 43 will vary from 1/64"-¾". The center drop distance 47 is provided, as shown in FIG. 5*f*, and will vary from about 1/64"-¾". The pad 43 defines a left to right taper varying from about 1/64"-¾", and terminates in a thin edge, and FIG. 5*f* shows the taper in the right to left direction. The front to back taper of the heel base pad 43 is the same or similar to that of FIG. 5*b*, i.e., about 1/64"-¾", terminates in a thin edge. The length and width of the heel base pads 43 and 44 are similar to that of the heel base pad 35.

Removable stacking pads 39 in FIG. 6*a* stack onto heel base pad 35, and are similarly shaped and contoured to fit over and be stabilized by the base pads 43 and to be self stabilized by any added stacking pads, without being attached to each other. The pads 39 have a fairly uniform thickness of about 1/64"-½" across their width. The front ends 40 of the removable pads preferably taper to a thin edge.

Additional height and/or inclination changes can be made to heel base pads 43 and 44 by removable stacking pads which are similarly shaped and similarly contoured to fit Over and be stabilized by the base pads 43 and 44 and any added stacking pads. In FIG. 6*b*, the removable stacking pads 45 have a maximum thickness of about 1/64"-½" at the left edge 46 of the heel base pad 43, and taper in thickness towards the right to a thin edge. Stacking pads 45 taper from back to front by about the same amount as stacking pads 39.

If desired, the center of the base pad 35, and/or the removable pads 39 may be pre-cut or perforated in a removable circular or oval shape 41. This also applies to base pads 43, 44 and stacking pads 45. Removal of shape 41 forms a central space 42 to provide a relatively pressure free space for a bone spur which might otherwise be painful. This will reduce or prevent pressure on the central part of the weight bearing heel, and potentially reduce discomfort due to the bone spur.

If desired, the removable lining element 10 shown in FIGS. 1 and 2 may be altered, and this may involve merging spaces 18, 19 and 20 in some combination. In the embodiment of FIG. 11, spaces 19 and 20 overlap into a single space 50. Other variations are possible such as by overlapping the heel space with the longitudinal arch and metatarsal arch spaces, or overlapping the metatarsal and longitudinal arch spaces. In these cases, the height adjustment pads at the overlapping sites are modified by either thinning one or more pads at the overlap sites or by cutting an overlap edge to accommodate an adjacent pad or pads, thus forming a smooth surface contour between the overlap edges of the pads.

The base pads and stacking pads for the metatarsal arch, longitudinal arch, and heel support areas may be constructed of the same or similar materials as in layers 13 or 14 of the lining element 10. Thus, elastic foam, material such as rubber, latex, polyurethane, neoprene, styrene-butadiene latex, polyethylene, polyolefins, pvc, etc., and combinations thereof are suitable. Also, elastic materials such as artificial and natural leather, cork, compressed natural or artificial fibers, etc., may be used. The compressed natural or artificial fibers which may be used include cotton, wool, nylon, polyesters, acrylics, etc., and blends thereof. The preferred foam materials are rubber, neoprene, latex, styrene-butadiene latex, styrene and polyethylene.

The deformable, elastic lining element or insole combined with the base pads and removable stacking pads of this invention enable an incremental adjustment of both the elevation and inclination of the user's feet. Also, the lining element combined with the individual base pad and stacking pads, as required by the user, provide individual adjustable and self stabilized supports at the metatarsal, longitudinal arch and heel areas, without requiring a means of attachment to each other.

Additionally, the deformable elastic lining element layers define and envelope the intrinsically formed support spaces to provide a resistive force towards the support element or elements, thereby preventing their lateral displacement within the support spaces.

The supports of this invention are relatively inexpensive and can be readily adjusted by the user, without necessitating assistance by a health care professional. Subsequent readjustments of the supports due to ongoing changes in the arch and heel areas, can be just as readily and as easily accomplished.

When the lining element or insole of this invention is used in conjunction with the heel and arch support components, they will provide a corrective support for the user's feet, thereby relieving pain and discomfort, and improve mobility. Also, in the appropriate situation, regular use of the supports may delay or prevent surgical intervention.

What is claimed is:

1. An insole liner for shoes with removable support elements therein, for height adjustment and alignment correction, comprising:

a.) a removable lining element providing at least two similarly shaped layers of deformable elastic material joined together to form a single piece structure and define separately between the layers an intrinsically formed metatarsal arch support space, an intrinsically formed longitudinal arch support space, and an intrinsically formed heel support space;

b.) intrinsically formed openings defined in the lining element leading to each of the support spaces, the openings being elastically deformable, and defining surface areas which are smaller than the surface areas of the corresponding lining element layers exposed to the spaces along which the openings lie, to permit deformable insertion and securement of one or more support elements into a support space and removal therefrom; and, c.) support elements for at least one of the said support spaces, the openings and spaces of the lining element enabling the positioning of a support element therein, the support elements being shaped for deformable insertion through a said opening of the insole liner and expansion into a support space and for securement therein, and being shaped for deformable removal from the support space, the support elements comprising a base pad, or a plurality of base and stacking pads, said stacking pads fitting over and being shaped and contoured to completely overlay a respective base pad and are self stabilized thereby, without requiring a fixed means of attachment to each other, each stacking pad being individually separable from an adjacent pad, for restacking purposes, the said base pad or said base and stacking pads imparting an adjustable height support and corrective alignment for a user's foot, the support elements being insertable or removable from the support spaces for treating an initial foot support problem and for subsequent readjustment of support and alignment for ongoing individual height and alignment changes in the arch and heel areas, by removal of the support elements and reinsertion of the base, or restacked base and stacking pad support elements, the deformable elastic lining element layers defining and enveloping the support spaces to provide a resistive force towards said base pad, or a plurality of said base and stacking pads, thereby preventing their lateral displacement within the support spaces.

2. The insole liner of claim 1, in which the liner comprises outer layers of fabric and inner layers of a foam material.

3. The insole liner of claim 1, in which the insole liner is constructed of materials, selected from the class consisting of: compressed natural or artificial fibers including cotton, wool, nylon, polyesters, acrylics and blends thereof; foam material, rubber, polyurethane, neoprene, latex, styrene-butadiene latex, polyethylene, polyolefin, pvc, and mixtures thereof; artificial leather or natural leather; and, cork.

4. The insole liner of claim 3, comprising at least two deformable elastic layers of foam material.

5. The insole liner of claim 3, comprising deformable elastic layers constructed of different materials.

6. The insole liner of claim 3, comprising deformably elastic layers constructed of the same material.

7. The insole liner of claim 1, each layer having a thickness of about 1/64"-¼".

8. The insole liner of claim 1, in which the metatarsal arch support space is positioned between the front end and mid portion of the lining element and approximately longitudinally along the liner midline, and the longitudinal arch support space is positioned about mid length of the lining element and displaced to an inner edge thereof, and the heel support space is positioned at the back end of the insole liner and across the width.

9. The insole liner of claim 3, wherein the said support elements further comprise a metatarsal base pad positioned in the metatarsal arch support space, and curving upwardly; and, the removable stacking pads are shaped and contoured to fit over the base pad and any added stacking pads, add incrementally to the length and width of a previous pad, provide a maximum height midway of the removable pad, and taper to a thin edge.

10. The insole liner of claim 9, in which the metatarsal base pad is about ½"-4" wide, and curves upwardly to about 1/64"-¾" of height; and, the removable stacking pads for the said base pad provide an increment in width and length of about 1/64"-½", and provide a height midway of the removable pad of about 1/64"-½" and, taper to a thin edge.

11. The insole liner of claim 3, wherein said support elements further comprise a longitudinal arch support base pad positioned in the longitudinal arch support space, and curving upwardly; and, the removable stacking pads for the base pad are shaped and contoured to fit over the base pad and any added stacking pads, add incrementally to the length and width of a previous pad, have a maximum height about midway of the removable pad, and taper to a thin edge.

12. The insole liner of claim 11, in which the longitudinal arch support base pad is about ½"-3" wide, about 1"-6" long, and curves upwardly to a height of about 1/64"-¾"; and, the removable stacking pads for the said base pad add incrementally to the length and width of a previous pad of about 1/64"-½", and have a midway thickness of about 1/64"-½" which taper to a thin edge.

13. The insole liner of claim 1, wherein said support elements further comprise a heel support base pad positioned in the heel support space, and providing a center drop distance from back to front, and downwardly tapering in height from back to front; and, the removable stacking pads are shaped and contoured to fit over the base heel pad and any added stacking pads, add incrementally to the height of a previous pad, provide a relatively uniform thickness, and taper to a thin front edge.

14. The insole liner of claim 13, in which the base heel pad varies in height from about 1/64"-¾" at the back end, defines a center drop distance of about 1/64"-¾", downwardly tapers in height from front to back by about 1/64"-¾", and varies from about 1"-6" in length and 1"-6" in width; and, the removable stacking pads provide a relatively uniform thickness of approximately 1/64"-½" across their, width, and taper to a thin front edge.

15. The insole liner of claim 3, wherein said support elements further comprise a heel support base pad positioned in the heel support space to provide a center drop distance from back to front, downwardly tapers in height from back to front, and tapers across the width; and, the removable stacking pads are shaped and contoured to fit over the base heel pad, and any added stacking pads, taper across their width and, taper to a thin front edge.

16. The insole liner of claim 15, in which the base heel pad provides a center drop distance from back to front varying from about 1/64"-¾", varies in height at the back end from about 1/64"-¾", downwardly tapers in height from back to front by about 1/64"-¾", terminating in a thin edge, and tapers across the width by about 1/64"-¾"; and, the removable stacking pads define a taper across the width from about 1/64"-½" in thickness, tapering to a thin edge, and also tapering to a thin front edge.

17. The insole liner of claim 1, in which at least two of said spaces overlap.

18. The insole liner of claim 1, in which at least two of said spaces overlap and provide overlapping base pads, or a plurality of base and stacking pads, and the said base pads and stacking pads are modified to provide a smooth contoured surface between edges of the pads.

* * * * *